US007288183B2

(12) United States Patent
Nicolaos et al.

(10) Patent No.: US 7,288,183 B2
(45) Date of Patent: Oct. 30, 2007

(54) PROCESS FOR DESULPHURIZING GASOLINE BY ADSORPTION

(75) Inventors: Alexandre Nicolaos, Puteaux (FR); Florent Picard, Saint Symphorien D'Ozon (FR)

(73) Assignee: Institut Francais Du Petrole, Rueil Malmaison Cedex (FR)

( * ) Notice: Subject to any disclaimer, the term of this patent is extended or adjusted under 35 U.S.C. 154(b) by 291 days.

(21) Appl. No.: 10/898,173

(22) Filed: Jul. 26, 2004

(65) Prior Publication Data

US 2005/0092655 A1 May 5, 2005

(30) Foreign Application Priority Data

Jul. 25, 2003 (FR) ..... 03 09198

(51) Int. Cl.
*C10G 67/16* (2006.01)

(52) U.S. Cl. ..... 208/208 R; 208/88; 208/211; 208/238; 208/299

(58) Field of Classification Search ..... 208/88, 208/208 R, 211, 238, 299
See application file for complete search history.

(56) References Cited

U.S. PATENT DOCUMENTS

| | | | | |
|---|---|---|---|---|
| 6,551,501 | B1 | 4/2003 | Whitehurst et al. | |
| 2002/0166798 | A1* | 11/2002 | Debuisschert et al. | 208/88 |
| 2003/0029776 | A1* | 2/2003 | Pradhan et al. | 208/238 |
| 2003/0042175 | A1 | 3/2003 | Debuisschert et al. | |
| 2003/0116474 | A1 | 6/2003 | Towler et al. | |

FOREIGN PATENT DOCUMENTS

| | | |
|---|---|---|
| EP | 1 057 879 | 12/2000 |

* cited by examiner

*Primary Examiner*—Glenn Caldarola
*Assistant Examiner*—Prem C. Singh
(74) *Attorney, Agent, or Firm*—Millen, White, Zelano & Branigan, P.C.

(57) ABSTRACT

The invention concerns a process for desulphurizing gasoline comprising a step for fractionating said gasoline under conditions in which a light fraction comprising the lightest thiophene compounds such as thiophene or methylthiophenes and a heavy fraction concentrating the heaviest aromatic sulphur-containing compounds are obtained. Said heavy fraction is treated by hydrodesulphurization, while the light fraction is brought into contact with a solid adsorbant to eliminate at least a portion of said light thiophene compounds.

16 Claims, 2 Drawing Sheets

PROCESS FOR DESULPHURIZING GASOLINE BY ADSORPTION

Figure 1:
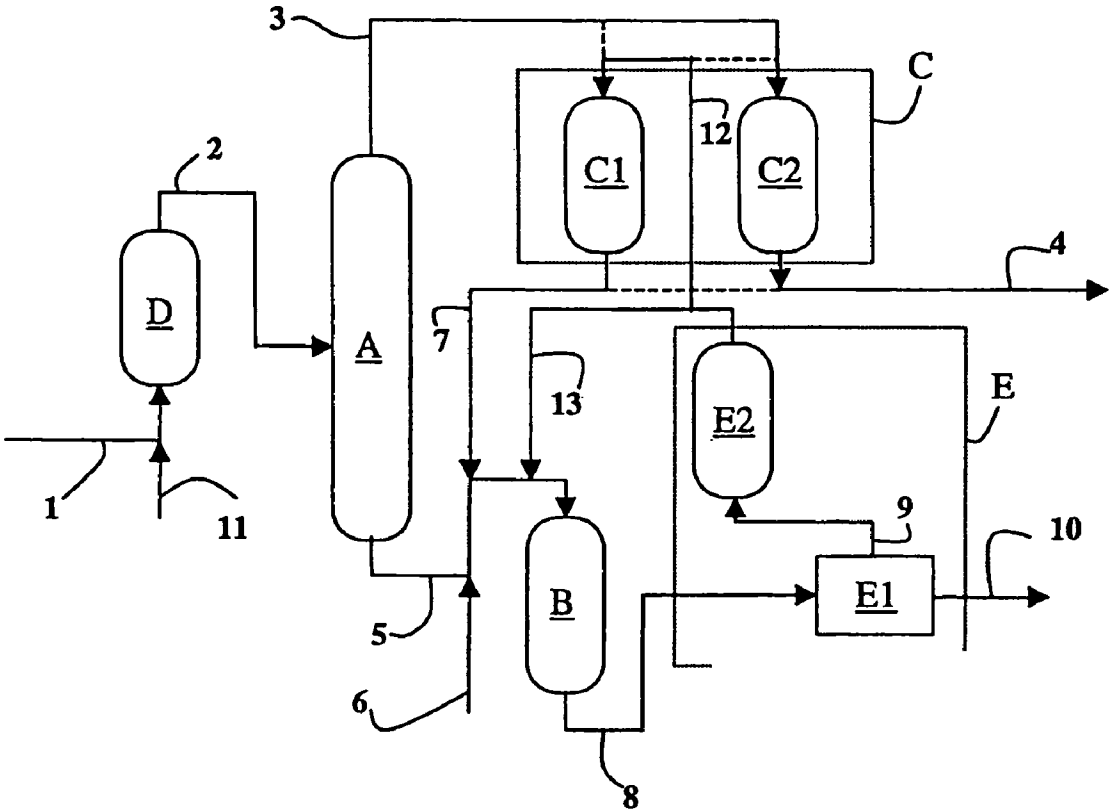

The present invention relates to a process for desulphurizing a mixture of hydrocarbons, typically a gasoline with boiling points in the range 25° C. to 300° C. The present process is of particular application in desulphurizing gasoline from a catalytic cracking process, fluid catalytic cracking, cokefaction, visbreaking or pyrolysis.

Future specifications for vehicle fuels will require a large reduction in the sulphur content of those fuels, and in particular gasoline. That reduction is intended in particular to limit the amount of sulphur and nitrogen oxides in the vehicle effluent gases. From 2000, European legislation has required that gasoline fuels should contain 150 pm of sulphur, 1% of benzene, 42% of aromatics, 18% of olefins. In 2005, these will amount to 50 ppm of sulphur and 35% aromatics. Specifications in the United States are also changing, requiring a gasoline to contain an average of 30 ppm of sulphur from 2004.

The change in sulphur content specifications in fuels thus necessitates the development of novel deep desulphurization processes for gasolines.

The principal sources of sulphur in gasoline stock are cracking gasolines, principally the gasoline fraction from a process for catalytic cracking of an atmospheric distillation residue or vacuum residue from a crude oil (FCC). The gasoline fraction from catalytic cracking, which represents an average of 40% of the gasoline stock, contributes more than 90% of the sulphur in such gasoline. As a result, the production of low sulphur gasoline necessitates a step for desulphurizing catalytic cracking gasoline. Other sulphur-rich gasoline sources that can be cited are cokefaction gasoline or, to a lesser extent, gasoline from atmospheric distillation, or steam cracking gasoline.

Currently, desulphurization is conventionally carried out in one or more steps for bringing sulphur-containing compounds contained in said gasoline into contact with a hydrogen-rich gas in a process known as hydrodesulphurization, in which the organic sulphur is transformed into hydrogen sulphide ($H_2S$) which is then separated from the desulphurized gasoline by degassing.

The octane number is routinely used as an indicator of the resistance to self-ignition of fuels, particularly gasoline. A high octane number for the gasoline produced is vital to the refiner in order to control the quality of that gasoline, with a view to a use as vehicle engine fuel.

Further, the octane number of gasoline is known to be linked to their olefin content. Thus, preserving the octane number of said gasoline necessitates limiting reactions transforming olefins into paraffins which are inherent to hydrodesulphurization processes. When gasoline is desulphurized using a conventional hydrodesulphurization process, it is known that olefin hydrogenation (saturation) reactions occurring in parallel to the transformation of sulphur-containing compounds to $H_2S$ results in a reduction in the octane number of the desulphurized gasoline finally recovered. Further, the quantities of hydrogen used in such processes are higher for greater degrees of desulphurization. High hydrogen partial pressures encourage olefin hydrogenation reactions. Thus, to restrict the sulphur contents of that gasoline, such processes result in very high losses in octane number.

Further still, when only conventional processes are used, the use of very large quantities of hydrogen in hydrodesulphurization units risks causing problems in managing that gas in the refinery.

To overcome this problem, International application WO-A-02/36718 proposes separating the FCC gasoline into an olefin-rich portion comprising only mercaptan type sulphur-containing compounds and a heavy portion which concentrates the thiophene and its derivatives (collectively known as thiophene compounds in the present application) and the heaviest sulphur-containing compounds.

The mercaptans present in the light fraction are then eliminated by a process which employs an extractive solution of sodium hydroxide. The heavy fraction is desulphurized by a process known as hydrodesulphurization.

The cut point for the two fractions, however, is relatively low (less than 165° F. (75° C.)), which limits the advantages of such a process, as the light fraction comprises a reduced portion of the hydrocarbons contained in the initial gasoline.

Known gasoline desulphurization routes also include processes for purifying gasoline by adsorption of the sulphur-containing compounds on a selective adsorbant.

As an example, U.S. Pat. No. 3,620,969 recommends using a zeolite to desulphurize a liquid hydrocarbon by adsorption.

U.S. Pat. No. 6,428,685 recommends contact with a specific solid containing a promoter comprising nickel the valency of which has been reduced to a value of 2 or less to desulphurize a FCC gasoline or gas oil.

The present invention pertains to a process for desulphurization by adsorption onto a solid adsorbant of a hydrocarbon cut as described above, for example a light or intermediate cut from a gasoline from a FCC process.

The present process can achieve both adsorption selectivity regarding thiophene compounds present in the initial feed, a lower hydrogen consumption and can also satisfy future specifications regarding sulphur in the gasoline.

Further, the present invention enables desulphurization of said hydrocarbon cut to be carried out with minimal octane number loss.

In accordance with the sequence proposed in the present invention, a minimal portion of the hydrocarbons contained in the initial cut is sent to a hydrodesulphurization unit.

In a preferred implementation in which adsorption is carried out in the gas phase, the present process can also minimize the gasoline loss during the adsorption-desorption step.

More particularly, the present invention provides a process for producing a low sulphur gasoline with a high octane number from an initial gasoline comprising olefins and thiophene compounds such as thiophene and/or methylthiophenes, said process comprising the following steps:

a) distilling the initial gasoline into at least two fractions, namely:
   - a fraction comprising at least the thiophene present in said initial gasoline, with an end point in the range about 70° C. to about 200° C.;
   - a heavy fraction comprising heavy sulphur-containing compounds;
b) eliminating thiophene compounds contained in said fraction with an end point in the range about 70° C. to about 200° C. by adsorption onto a solid adsorbant;
c) treating said heavy fraction under hydrodesulphurization conditions.

In accordance with a possible implementation of the invention, the initial gasoline is distilled during step a) into at least three fractions, namely:

- a light fraction comprising the compounds contained in the initial gasoline the boiling point of which is lower than the boiling point of thiophene;

an intermediate fraction comprising at least the thiophene present in said initial gasoline, with an end point in the range about 70° C. to about 200° C.;

a heavy fraction comprising the heavy sulphur-containing compounds;

and in which the intermediate fraction is treated in accordance with step b).

In general, said initial gasoline comprises aromatics and during step a), the cut point for said distillation is selected as a function of the composition of the initial gasoline to be treated and/or as a function of the concentration of aromatic hydrocarbons present in the fraction comprising at least the thiophene present in said initial gasoline, with an end point in the range about 70° C. to about 200° C.

As an example, the percentage by weight of aromatic compounds in said fraction is less than 25%.

The present process may also include a prior step for selective hydrogenation of at least a portion of the dienes and acetylenes contained in the initial gasoline.

The present process can also comprise a prior step for rendering heavier the mercaptans and saturated sulphur-containing compounds having a boiling point that is lower than that of thiophene.

In a first implementation, the adsorption of step b) is carried out in the liquid phase.

In a further implementation, step b) is carried out in the gas phase.

Advantageously, the adsorbant comprises at least one element from the group constituted by silicas, aluminas, zeolites, activated charcoal, resins, clays, metal oxides and reduced metals.

Further, the present process can comprise a prior step for extracting at least a portion of the nitrogen-containing compounds contained in the initial gasoline.

The present process can in particular be used to treat an initial gasoline derived from or comprising a hydrocarbon fraction derived from a catalytic cracking process, a fluid catalytic cracking process, from cokefaction, from visbreaking or from pyrolysis.

The conditions for carrying out the process can, for example, be those described below. The following description is given by way of illustration and does not in any way limit the application of the present process. In this description, the initial hydrocarbon cut is arbitrarily selected to be a gasoline cut from a FCC process, assumed to be representative of cuts to which the present process may be applied.

Fractionation (Step a):

In a first implementation of the invention (mode I), the gasoline is fractionated into two fractions:

a light fraction containing the majority of olefins containing 5 or 6 carbon atoms as well as thiophenes, and preferably methyl thiophenes;

a heavy fraction containing no more olefins containing 5 carbon atoms and concentrating the heavy sulphur-containing compounds such as benzothiophenes.

Since thiophene forms azeotropes with hydrocarbons, the cut point can be lower than the boiling point of thiophene (84° C.). The light fraction thus generally has an end point in the range from about 70° C. to about 200° C., preferably in the range about 80° C. to about 160° C., and more preferably between about 90° C. and about 130° C. or even between 90° C. and 110° C. This separation is carried out conventionally in a distillation column.

In a second preferred implementation of the invention (mode II), the gasoline is distilled into three fractions:

a light fraction comprising the compounds contained in the initial gasoline with a boiling point which is lower than the boiling point of thiophene;

an intermediate fraction comprising at least thiophene with an end point in the range about 70° C. to about 200° C., preferably in the range about 80° C. to about 160° C., more preferably in the range about 90° C. to about 130° C., or in the range about 90° C. to about 110° C.;

a heavy fraction concentrating the heavy sulphur-containing compounds such as a benzothiophene;

In an advantageous mode of the invention, the cut point of said distillation is selected as a function of the composition of the initial gasoline to be treated and/or as a function of the concentration of aromatic hydrocarbons present in the light fraction (mode I) or in the intermediate fraction (mode II) after fractionation.

The Applicant has unexpectedly discovered that during adsorption step b) described below, the desulphurization efficacy is higher if the percentage by weight of aromatic compounds in said fraction is less than 25%, preferably less than 10% and more preferably less than 5%.

In a preferred implementation of the invention, the end point is selected as a function of the composition of the initial gasoline before fractionation to send only a minimal portion of hydrocarbons to hydrodesulphurization step c) and to minimize the percentage by weight of aromatic compounds present in the fraction sent to step b).

Adsorption/Desorption (Step b):

This step consists of eliminating the sulphur-containing compounds present in the light fraction (mode I) or in the intermediate fraction (mode II) from step a).

In a preferred mode, said fractions have initially been depleted in mercaptan type compounds, for example by means of a selective hydrogenation step which will be described below. This step can be carried out by bringing the feed to be treated into contact with a solid adsorbant having a high affinity for sulphur-containing compounds, preferably thiophene compounds. The solids used can be selected, alone or as a mixture, from families of adsorbants which are known to the skilled person selected from silicas, aluminas, zeolites, preferably faujasites, activated charcoals, resins, clays, metal oxides and reduced metals. It is possible to use a solid adsorbant having an increased adsorption capacity for sulphur-containing compounds obtained by physical surface treatments such as heat, or chemical treatments, for example grafting specific molecules onto the surface. It is also preferable to use solids the residual acidity of which is controlled to prevent coking reactions of olefins which can cause rapid aging of the solid used. To avoid this type of phenomenon it is possible, for example, to carry out potassium hydroxide or sodium hydroxide treatments. In the case in which the quantity of sulphur-containing compounds adsorbed onto the solid is very high, the solid does not have to be regenerated but is simply changed once it has been saturated. However, preferably, the solid is regenerated and this step is carried out by adsorption/regeneration cycles which are known per se to the skilled person. In this case, the experimental conditions are selected by the skilled person to maximize the dynamic capacity of the solid, for example by taking into account the quantity of sulphur retained in the adsorption phase and the quantity of liquid solvent or gas necessary to completely or partially regenerate the solid.

In accordance with the invention, the fraction can be treated in the liquid or gas phase. When adsorption is carried out in the liquid phase, it may be carried out under mild temperature and pressure conditions, retaining the liquid phase and being typically from 0° C. to 100° C. and 0.1 to 10 MPa, and preferably from ambient temperature to 50° C. and 0.2 to 3 MPa. Regeneration can be carried out using a regeneration solvent (or desorbant) which is free of sulphur and which has a low or high desorbing power. In general, the desorbant is selected to selectively replace the gasoline retained in the pores then to cause desorption of all of the other compounds retained on the solid, including the sulphur-containing compounds. It may then be necessary to regenerate the regenerate solvent by distillation, if available, and recycling. The solvent preferably comprises at least a portion (at least 20%) and preferably a majority (at least 50%) of aromatic type compounds.

In one implementation of the invention, initial draining can be carried out on the hydrocarbons retained in the pores after the adsorption phase and prior to passage of the desorbant. This can minimize mixing between said hydrocarbons and the regeneration solvent. In a further mode, the scope of the invention encompasses carrying out stripping of the retained compounds using a hot inert or non-inert gas instead of using a solvent. The temperature of said gas can be between 50° C. and 500° C. and is preferably between 80° C. and 300° C. This gas may be nitrogen, steam, light hydrocarbons or hydrogen, or any other gas known to the skilled person.

In an advantageous implementation, desorption is encouraged by increasing the temperature of the adsorbant bed during the adsorption phase; the gasoline trapped in the pores is recovered directly by simple stripping without carrying out prior drainage aimed at recovering the contents of the pores in the solid.

Adsorption is preferably carried out in the gas phase. In this case, after the adsorption phase, the regeneration phase can commence by stripping with a hot inert or non inert gas such as nitrogen, hydrogen, light hydrocarbons or steam prior to evacuating the gasoline retained in the pores. The temperature of this gas may be between 50° C. and 500° C., preferably between 80° C. and 300° C. In this implementation, the quantity of gasoline retained in the gas phase in the pores of the adsorbant is much lower than the quantity of gasoline retained in the liquid phase. This minimizes yield losses. It is then possible to continue desorption of the sulphur-containing compounds adsorbed on the surface of the adsorbant using the same hot gas.

Hydrodesulphurization of the Heavy Fraction (Step c):

In accordance with the invention, the sulphur-rich heavy fraction of the gasoline produced by step a) undergoes a desulphurization treatment. This step can be carried out by passing the gasoline in the presence of hydrogen over a catalyst comprising at least one element from group VIII (metals selected from iron, ruthenium, osmium, cobalt, rhodium, iridium, nickel, palladium and platinum) and/or at least one element from group VIB (element selected from the group constituted by chromium, molybdenum and tungsten), at least partially in the sulphide form. The reaction temperature is generally in the range 220° C. to 340° C. at a pressure in the range from about 1 to 4 MPa. The hourly space velocity is in the range about 1 $h^{-1}$ to 20 $h^{-1}$. The ratio of the hydrogen flow rate to the feed flow rate is in the range 100 to 600, expressed in normal litres of hydrogen per litre of gasoline.

The catalyst used to carry out hydrodesulphurization of the heavy fraction comprises between 0.5% and 15% by weight of group VIII metal, the percentage being expressed in the oxide form. The weight content of the group VIB metal is generally in the range 1.5% to 60% by weight, preferably between 3% and 50% by weight. The group VIII element is preferably cobalt and the group VIB element is preferably molybdenum or tungsten. The catalyst support is normally a porous solid such as magnesia, silica, titanium oxide or alumina, used alone or as a mixture.

This hydrodesulphurization step c) can also comprise a hydrodesulphurization finishing step carried out on a catalyst comprising at least one element from group VIII, preferably selected from the group formed by nickel, cobalt and iron. The amount of metal in the catalyst is generally in the range about 1% to about 60% by weight in the oxide form. This finishing step can eliminate residual sulphur-containing compounds, principally saturated sulphur-containing compounds which have formed during the first hydrodesulphurization step. The reaction temperature is generally in the range 240° C. to 360° C. and must be at least 10° C. higher than the inlet temperature of the first hydrodesulphurization step. The pressure is in the range about 1 to 4 MPa. The hourly space velocity is in the range about 1 $h^{-1}$ to 20 $h^{-1}$. The ratio of the flow rate of hydrogen to the flow rate of feed is in the range 100 l/l to 600 l/l, expressed in normal litres of hydrogen per litre of gasoline.

Selective Hydrogenation:

This optional step, carried out prior to steps a), b), c), is intended to eliminate at least part of the diolefins present in the gasoline and to transform the light sulphur-containing compounds by rendering them heavier. Diolefins are gum precursors which polymerize in the hydrodesulphurization or adsorption reactors, in particular if the adsorbant is acidic, limiting their service life.

This step can also transform light sulphur-containing compounds selected from the list constituted by mercaptans, sulphides and $CS_2$, with a boiling point which is generally lower than that of thiophene, into heavier sulphur-containing compounds the boiling point of which is higher than that of thiophene. In the present process, a majority of said heavy compounds formed are evacuated in the heavy fraction after fractionation (step a).

This step is generally carried out in the presence of a catalyst comprising at least one group VIII metal, preferably selected from the group formed by platinum, palladium and nickel, and a support. As an example, a catalyst containing 1% to 20% by weight of nickel deposited on an inert support such as alumina, silica, silica-alumina, a nickel aluminate or a support containing at least 50% alumina, is used. This catalyst operates at a pressure of 0.4 to 5 MPa, at a temperature of 5° C. to 250° C., with an hourly space velocity of liquid of 1 $h^{-1}$ to 10 $h^{-1}$. A further metal from group VIB can be associated to form a bimetallic catalyst, for example molybdenum or tungsten. This group VIB metal, if associated with the group VIII metal, is deposited in an amount of 1% by weight to 20% by weight on the support.

The choice of operating conditions is particularly important. Most generally, pressure is used in the presence of a quantity of hydrogen that is in slight excess with respect to the stoichiometric value necessary to hydrogenate the diolefins. The hydrogen and the feed to be treated are injected as downflows or upflows into a reactor, preferably with a fixed bed of catalyst. The temperature is more generally in the range 50° C. to 300° C., preferably in the range 80° C. to 250° C., and preferably in the range 120° C. to 210° C.

The pressure is selected so that it is sufficient to maintain more than 80% and preferably more than 95% by weight of the gasoline to be treated in the liquid phase in the reactor; more generally, it is 0.4 to 5 MPa and preferably more than 1 MPa. An advantageous pressure is in the range 1 to 4 MPa, limits included. The hourly space velocity under these conditions is of the order of 1 to 12 $h^{-1}$, preferably of the order of 2 to 10 $h^{-1}$.

The light fraction of the catalytic cracking gasoline cut can contain up to a few % by weight of diolefins. After hydrogenation, the diolefin content is reduced to less than 3000 ppm, or even less than 2500 ppm, preferably less than 1500 ppm. In certain cases, less than 500 ppm can be obtained. The dienes content after selective hydrogenation may even be reduced to less than 250 ppm.

Concomitantly with the selective hydrogenation of diolefins, the double bond of external olefins is isomerized to internal olefins. This isomerization results in a slight increase in the octane number (or compensation of the octane number due to a slight reduction in olefins). This is due to the fact that internal olefins generally have a higher octane number than that of terminal olefins.

In accordance with one implementation of the invention, this step is carried out in a catalytic hydrogenation reactor which comprises a catalytic reaction zone traversed by the whole of the feed and the quantity of hydrogen necessary to carry out the desired reactions.

In a further implementation of the invention, the selective hydrogenation step can be carried out at the same time as the fractionation step d), for example in a catalytic column.

The invention will be better understood from the following description, made with reference to FIG. 1, of an apparatus that can be used to carry out the present process.

A gas from a cracking unit is sent via a line 1 to a selective hydrogenation reactor D, mixed with a stream of a gas comprising hydrogen via a line 11. This reaction section can optionally comprise a catalyst that is capable of both hydrogenating diolefins and rendering light mercaptan type sulphur-containing compounds heavier. The effluent from reactor D is sent via a line 2 to distillation means A which produces an overhead light fraction, along with a heavy fraction from the column bottom.

The light fraction recovered via line 3 is sent to desulphurization means using vapour phase adsorption comprising capacities C1 and C2. A step for heating said fraction may be necessary to obtain complete vaporization. The adsorption desulphurization means in this example comprise two capacities disposed in parallel. Alternatively, one capacity functions in adsorption when the other functions in desorption. Swinging from one functional mode to the other is achieved by means of systems for opening and closing valves (not shown). For clarity, the solid lines in FIG. 1 show the functional mode of the unit in which the capacity C1 is in the desorption phase while the capacity C2 is in the adsorption phase. Capacity C1 is supplied with a desorption gas via a line 12. The desulphurized gasoline recovered from the outlet from capacity C2 via line 4 can be sent to the gasoline pool via a line 4. After drainage, the effluent from the outlet from capacity C1 in the desorption phase concentrates the sulphur-containing compounds in the desorption gas and is evacuated via a line 7. The sulphur-containing compounds concentrated in this effluent can then readily be treated using any known desulphurization means.

The heavy fraction from the distillation means A is sent via a line 5 to the desulphurization section B as a mixture with the hydrogen stream introduced via a line 6. The effluent evacuated via a line 8 is sent to a stripping section E. The heavy desulphurized section is separated from the hydrogen and $H_2S$ in section E after cooling and is sent to the gasoline pool via a line 10.

The following non-limiting examples will provide a better understanding of the advantages of the present invention.

EXAMPLE 1

A "model" gasoline I, reproducing the proportions of olefins (1-hexene), paraffins (n-heptane), sulphur-containing compounds (thiophene) and aromatic compounds (meta-xylene) normally encountered in a non-fractionated cracking gasoline, was synthesized. Table 1 shows the characteristics of said feed I.

TABLE 1

| compound | mass (g) | % by weight | ppm S |
|---|---|---|---|
| 1-hexene | 682.64 | 39.94 | |
| thiophene | 2.23 | 0.13 | 497.0 |
| n-heptane | 598.17 | 34.99 | |
| meta-xylene | 426.27 | 24.94 | |

EXAMPLE 2

A gasoline II reproducing the proportions of olefins (1-hexene), paraffins (n-heptane), sulphur-containing compounds (thiophene) and aromatic compounds (meta-xylene) of the light fraction obtained after fractionation at 90° C. of the "model" gasoline of Example 1 was synthesized. Table 2 shows the characteristics of said feed II.

TABLE 2

| compound | mass (g) | % by weight | ppm S |
|---|---|---|---|
| 1-hexene | 900.2 | 52.92 | |
| thiophene | 0.55 | 0.03 | 123.2 |
| n-heptane | 765.7 | 45.02 | |
| meta-xylene | 34.5 | 2.03 | |

EXAMPLE 3

To provide a direct comparison of the values obtained in Example 4 below, a gasoline III was used which substantially comprised the same proportions of non-sulphur-containing hydrocarbons as the feed of Example 1 but with quantities of sulphur (thiophene) close to those of Example 2.

Table 3 shows the characteristics of said feed III.

TABLE 3

| compound | mass (g) | % by weight | ppm S |
|---|---|---|---|
| 1-hexene | 681.75 | 40.03 | |
| thiophene | 0.57 | 0.03 | 127.5 |
| n-heptane | 595.16 | 34.95 | |
| meta-xylene | 425.45 | 24.98 | |

EXAMPLE 4

Figure 2:
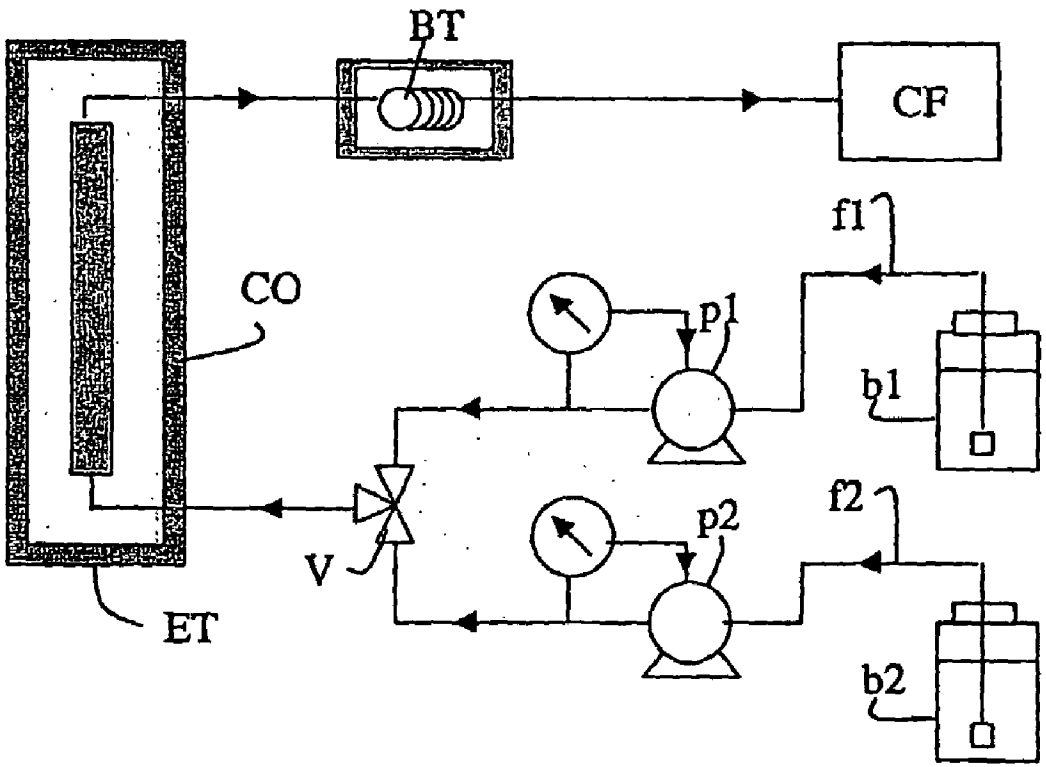

In this example, an adsorption rig with the flowchart shown in FIG. 2 was used. The bench was composed of two tanks b1 and b2 respectively containing solvent and feed. Parallel fluid circuits f1 and f2 with pumps p1 and p2 alternately supplied a column CO containing an adsorbant via a multi-way valve V. Said column was contained in an oven ET maintained at a constant temperature of 30° C. the effluents from said column were cooled in a bath thermostatted at 15° C. then sent to a fraction collector CF connected to a chromatographic analysis apparatus.

The column used contained type NaX zeolite (13×) previously activated at 400° C. in a stream of nitrogen.

The column and all of the lines were filled with reference solvent, which in the present example was n-heptane. The lines running from the feed tank to the multi-way valve were filled with feed then at t equals zero, the feed was passed into the column, in the meantime starting up the fraction collector. The volume of feed had to be sufficient to reach the saturation stage. It was determined by means of static experiments. All of the samples were analyzed by gas chromatography and the change in the concentration of sulphur as a function of the eluted volume was measured at the apparatus outlet to produce the adsorption curve. The quantity of sulphur-containing compounds adsorbed was calculated from said curve and could produce an adsorption isotherm for thiophene at the injection concentration, i.e. a quantity adsorbed for a given temperature as a function of the initial concentration. We also calculated a volume of treated feed which corresponded to the quantity of feed which could be passed over an adsorbant bed to reach a limiting concentration of 10 ppm of S in the recovered hydrocarbon solution.

The feeds synthesized in Examples 1 to 3 were treated using the experimental mode described above. The experimental results obtained during adsorption of the sulphur-containing compounds are summarized in Table 4.

The results obtained were as follows:

TABLE 4

| feed | $C_{initial}$ (ppm S) | aromatics content (weight %) | $Q_{ads}$ (mgS/g solid) | $K = Q_{ads}/C_{initial}$ | V treated (ml) |
|---|---|---|---|---|---|
| I | 497 | 25 | 3.6 | $7.2 \times 10^{-3}$ | 441 |
| II | 123.2 | 2.0 | 1.44 | $11.7 \times 10^{-3}$ | 930 |
| III | 127.5 | 25 | 0.49 | $3.84 \times 10^{-3}$ | 210 |

in which:
$Q_{ads}$ = quantity adsorbed, in mg of sulphur per gram of solid;
$C_{initial}$ = initial concentration of sulphur, in ppm of sulphur;
K = affinity of solid with respect to thiophene: ratio between the quantity of sulphur adsorbed on the solid and the initial sulphur concentration (local slope of adsorption isotherm);
V = volume treated, milliliters.

The results obtained show that for the same quantity of adsorbant, the volume treated of model gasoline II derived from fractionation was higher than the treated volume of unfractionated gasoline I. Further, a comparison of gasolines II and III at iso-sulphur contents allowed us to demonstrate that the adsorbed quantity of sulphur was higher in the case of fractionated gasoline II than that adsorbed in the case of gasoline III. These results are explained by increased selectivity for sulphur-containing compounds in the case of fractionated gasoline II linked to a low aromatic compounds content.

The invention claimed is:

1. In a process for producing a low sulphur gasoline with a high octane number from an initial gasoline comprising olefins, aromatic and thiophene compounds, said process comprising the following steps:

a) distilling the initial gasoline into at least two fractions, namely:

a first fraction comprising the thiophene compounds present in said initial gasoline, having an end point in the range about 70° C. to about 200° C.; and a second fraction which is a heavy fraction comprising heavy sulphur-containing compounds;

b) eliminating the thiophene compounds contained in said fraction having an end point in the range about 70° C. to about 200° C. by adsorption onto a solid adsorbent, said adsorbent comprising at least one constituent from silicas, aluminas, zeolites, activated charcoal, resins, clays, metal oxides or reduced metals; said adsorbent having been pretreated to lower residual acidity: and c) treating said heavy fraction under hydrodesulphurization conditions;

the improvement comprising monitoring the percentage of aromatic compounds in the first fraction in step (a) and conducting the distillation so that the percentage by weight of aromatic compounds in said first fraction is less than 25%.

2. A process according to claim 1, in which the initial gasoline is distilled during step a) into at least three fractions, namely:

a light fraction comprising compounds contained in the initial gasoline the boiling point of which is lower than the boiling point of thiophene;

an intermediate fraction comprising at least the thiophene present in said initial gasoline, with an end point in the range 70° C. to about 200° C.;

a heavy fraction comprising the heavy sulphur-containing compounds;

and in which the intermediate fraction is treated in accordance with step b).

3. A process according to claim 1, further comprising a prior step for selective hydrogenation of at least a portion of the diene and acetylene compounds contained in the initial gasoline.

4. A process according to claim 1, further comprising a prior step for rendering heavier mercaptans and saturated sulphur-containing compounds into compounds having a boiling point that is lower than that of thiophene.

5. A process according to claim 1, in which the adsorption of step b) is caffied out in the liquid phase.

6. A process according to claim 1, in which the adsorption of step b) is caffied out in the gas phase.

7. A process according to claim 1, said gasoline containing nitrogen-containing compounds, and further comprising a prior step for extracting at least a portion of the nitrogen-containing compounds contained in the initial gasoline.

8. A process according to claim 1, in which the initial gasoline comprises a hydrocarbon fraction derived from a catalytic cracking process, a fluid catalytic cracking process, from cokefaction, from visbreaking or from pyrolysis.

9. A process according to claim 1, the distillation in step (a) is conducted so that the percentage by weight of aromatic compounds in said first fraction is less than 10%.

10. A process according to claim 1, the distillation in step (a) is conducted so that the percentage by weight of aromatic compounds in said first fraction is less than 5%.

11. A process according to claim 1, further comprising subjecting the solid adsorbent to desorption in an adsorption/regeneration cycle.

12. A process according to claim 11, wherein said adsorption/regeneration cycle comprises an adsorption phase and a desorption phase, and the adsorbent is increased in temperature during the adsorption phase so as to facilitate desorption in the desorption phase.

13. A process according to claim 5, further comprising subjecting the solid adsorbent to desorption in an adsorption/regeneration cycle.

14. A process according to claim 6, further comprising subjecting the solid adsorbent to desorption in an adsorption/regeneration cycle.

15. A process according to claim 1, wherein the initial gasoline is a light or intermediate cut from an FCC gasoline.

16. A process according to claim 1, wherein the adsorbent is pretreated by a process comprising contacting the solid adsorbent with sodium hydroxide or potassium hydroxide.

* * * * *